United States Patent [19]

Hiller

[11] 3,972,175

[45] Aug. 3, 1976

[54] METHOD OF PROVIDING WIRE STRAND FROM A STRAND PRODUCTION FACILITY

[75] Inventor: Carl D. Hiller, Williamsport, Pa.

[73] Assignee: Bethlehem Steel Corporation, Bethlehem, Pa.

[22] Filed: Dec. 10, 1974

[21] Appl. No.: 531,270

Related U.S. Application Data

[63] Continuation of Ser. No. 404,587, Oct. 9, 1973, abandoned.

[52] U.S. Cl. ..... 57/145; 57/161

[51] Int. Cl.[2] ..... D07B 1/06

[58] Field of Search ..... 57/145, 161

[56] References Cited

UNITED STATES PATENTS

| | | | |
|---|---|---|---|
| 1,481,934 | 1/1924 | Sunderland | 57/145 |
| 1,919,509 | 7/1933 | Grobl | 57/145 |
| 3,358,435 | 12/1967 | Peene | 57/145 |
| 3,425,207 | 2/1969 | Campbell | 57/145 |

*Primary Examiner*—Donald E. Watkins

*Attorney, Agent, or Firm*—Joseph J. O'Keefe; Michael J. Delaney; Anson W. Biggs

[57] ABSTRACT

A method of making a series of wire strand sizes bracketing the most frequently requested strand sizes from a limited number of predetermined wire sizes such as two or three stock wire sizes by combining the stock wires together into a predetermined pattern to make any required strand size in the series. By producing wire strands in accordance with the invention the inventory of wire normally kept on hand in a production facility is decreased and the promptness with which orders for strands may be supplied is increased.

4 Claims, 4 Drawing Figures

METHOD OF PROVIDING WIRE STRAND FROM A STRAND PRODUCTION FACILITY

This is a continuation of application Ser. No. 404,587, filed Oct. 9, 1973, now abandoned.

BACKGROUND OF THE INVENTION

This invention relates to a wire strand and cable and more particularly to the expeditious production of various strand sizes from a production facility with a minimum of excess inventory of wire.

In the normal production facility for producing wire strand it is customary, when an order is received for a length of strand, to immediately order the requisite wire for production of the strand. Most strand is ordered by size, such as one and three quarters inch strand, two inch strand, and so forth. Since there is always a possibility of receiving a length of wire having a defect in it or damaging a portion of a wire while stranding it in a stranding machine, it is customary to order more wire than is actually needed for the length of strand for which an order has been received. The specifications for some strand products such as boom pendants and the like forbid the use of welds in the component wires and thus if a wire should break during stranding into a strand the entire length of wire must be discarded at least for the particular order being fabricated. Furthermore, since there are many different sizes of strands and many manners in which wires of various sizes may be combined together to make a strand of a given size, it has been customary for the wire of a particular size suited for each specific strand to be especially ordered for each strand. Special order wire must, of course, be especially made and it is necessary to fit such orders in between other orders for wire so that often there is a significant and even a considerable time interval involved in supplying the wire. This is true whether the wire in question is to be supplied from another shop of the same production facility or whether it has to be ordered from an outside source. After the strand has been manufactured it is often the case if the fabrication has gone well that a considerable length of excess wire is left over. This wire is then held in inventory until another use, usually in the making of a strand of the same type, is found for the wire. Since there are a number of different sizes of wire used in various strands, it is frequently some time before the same size and type of wire is required again. The amount of wire held in inventory thus tends to become greater and greater, often building up to completely impractical amounts. It is not unusual for the wire inventory in a strand and/or wire rope shop to amount to three or four hundred tons or even more. All this excess wire held in inventory is a drain on working capital since it ties up money in unused wire supply and also is a waste both of storage space and of the labor necessary to keep track of wire in inventory and to find inventory stock when it is required for the making of a new order of strand.

Occasionally when difficulties are encountered during the fabrication of the strand from the wire due to breakage of or defects in the wire, particularly where welds are now allowed in the wire in a particular product, it may result that insufficient extra wire is initially ordered to complete the order and fabrication of the order must be held up until additional wire is especially reordered.

SUMMARY OF THE INVENTION

The foregoing difficulties and problems associated with prior art methods of producing wire strand have now been obviated by the present invention. The present inventor has discovered that, due to the peculiarities of wire sizes and particularly the unique relationship which exists between certain combinations of two wire sizes such as for instance three-sixteenths and one-quarter inch nominal diameter wire, it is possible to make a whole series of stock type wire strands having size increments of only fractions of a inch or centimeter between strands and such that a suitable strand can be supplied from the series to fulfill almost any order for strand, using only a limited number of wire sizes. In this manner only a limited amount of wire need by kept in inventory since any excess wire left over from the production of one strand size can be easily applied to the production of another strand size. In addition, the limited number of stock sizes of wire can be more quickly supplied from a wire production facility. Alternatively, it is a simple matter to maintain a small permanent inventory of the limited number of stock wire sizes required to make strand according to the present invention so that each order of strand can be made up as soon as a stranding machine is available and without having to order the requisite wire from a wire production facility. As the stock wire is used immediately from inventory, it is a simple matter for a stock clerk to reorder as necessary to maintain the desired level of inventory. Reordering can be accomplished either as wire stock is actually used or as the order for strand is received, but before the strand on order is actually fabricated. In either case no waiting is required for the arrival of the requisite wire before the order for the strand can be fulfilled by stranding the order, yet the inventory level can be kept low, avoiding the tying up of capital in excess inventory, possible deterioration of the wire held in inventory and the inevitable costs and inefficiencies inherent in the maintenance of a large inventory of many different sizes of wires. Furthermore, in the event that difficulty is encountered in stranding a product with the wire ordered, additional wire can usually be drawn from the inventory of stock wire sizes to complete the order without delay.

The predetermined series of wire strand sizes is preferably in accordance with the invention made in one of two manners. In one variation of the invention the wire is stocked in three wire sizes in which wire of the first size, which is used only as the center wire of the strand, is the largest wire, the second wire is slightly smaller than the first wire size and the third wire size is smaller than the second wire size by approximately one half of a predetermined interval between the stock sizes of strand which it has been determined to customarily supply to customers. In the English system of measurement this series of strands may be conveniently made with one eighth inch intervals between the predetermined strand sizes.

In the other preferred variation of the strand supply system of the invention only two wire sizes are used to make a series of strands in which the size interval between nominal strand sizes may desirably be one-sixteenth of an inch. Both variations will normally make use of substantially the same wire sizes.

DESCRIPTION OF THE PREFERRED EMBODIMENTS

Figure 1:
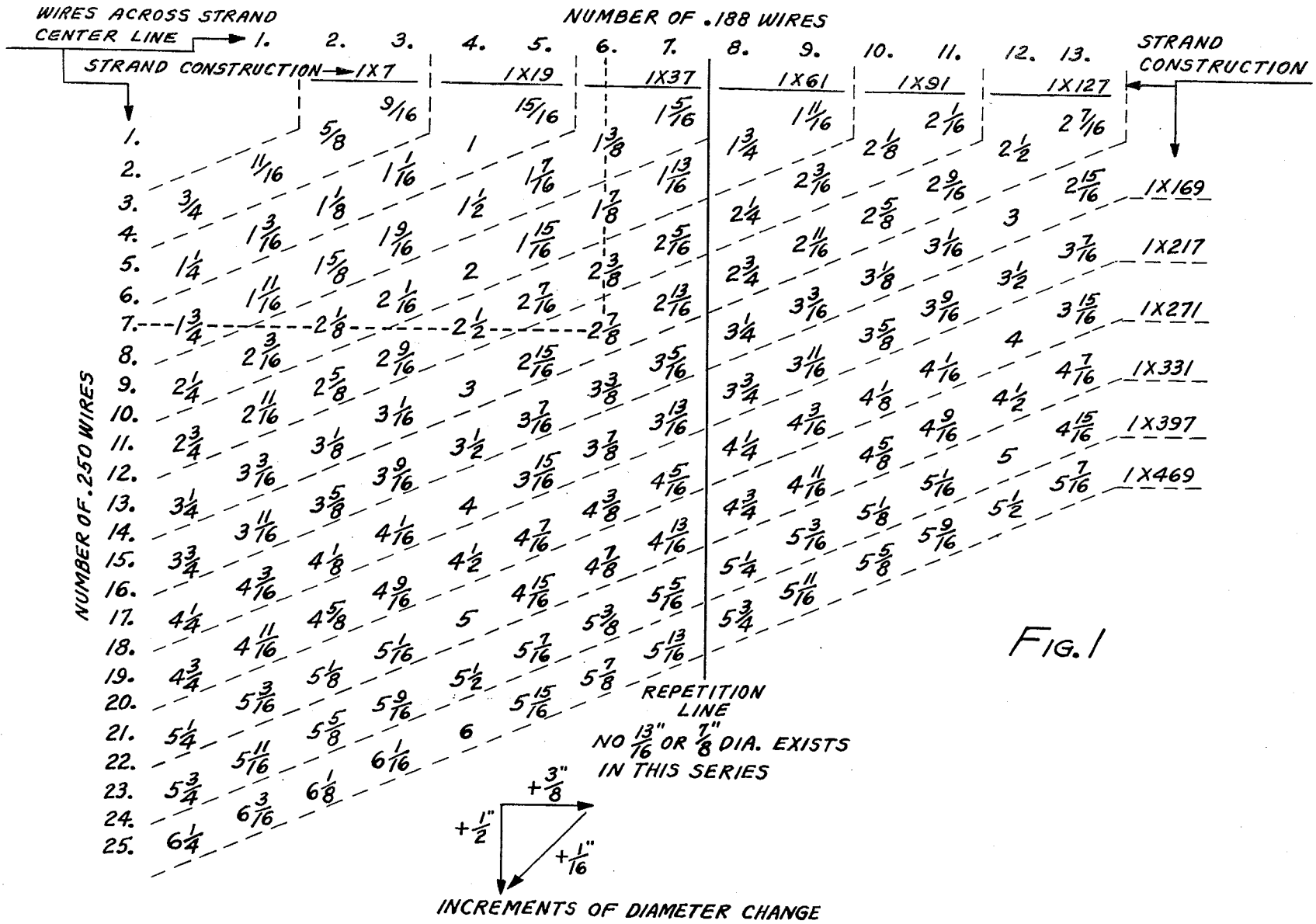
FIG. 1 is a table illustrating the series of strands which can be made from two wire sizes according to one variation of the invention.
Figure 2:
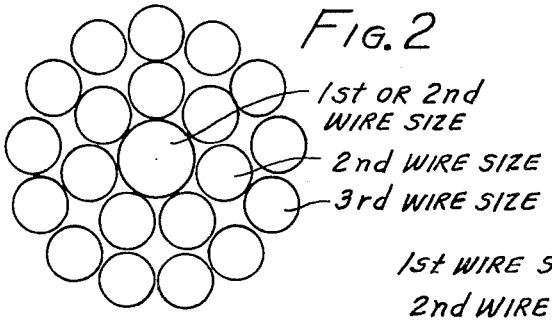
FIG. 2 is a cross-section of a strand which can be made according to Table 1 wherein three wire sizes are provided.
Figure 3:
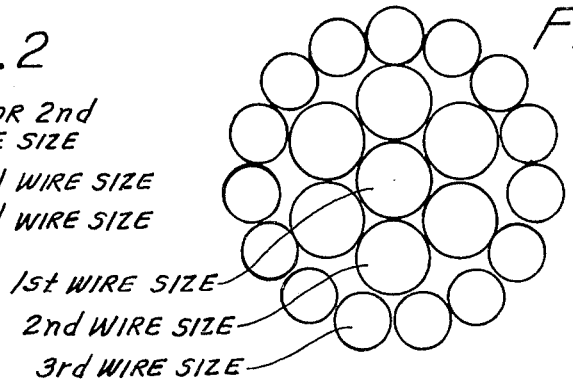
FIG. 3 is a cross-section of another strand which can be made according to Table 1 wherein three wire sizes are used.
Figure 4:
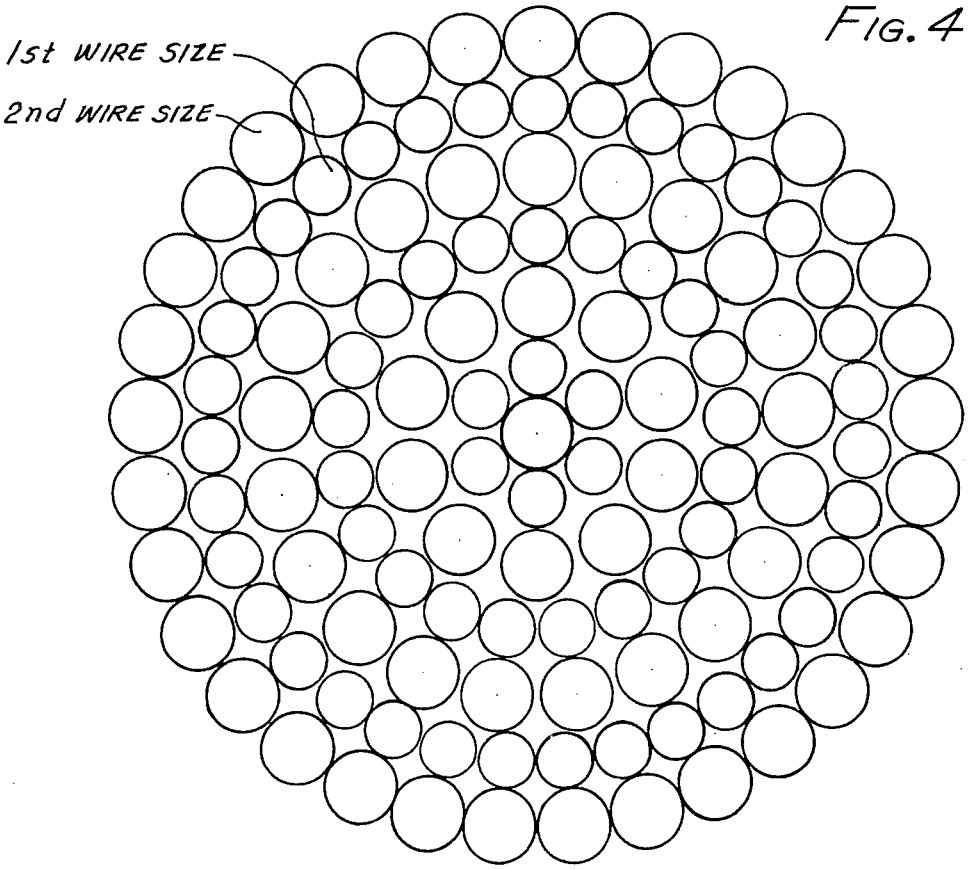
FIG. 4 is a cross-section of a strand which is formed from two wire sizes according to FIG. 1.

In accordance with the present invention a conventional stranding apparatus for the stranding of wire strand is used to strand orders for strand in a predetermined series of strand sizes having constant size intervals between the nominal sizes of strand to be produced.

The present inventor has devised a system of supplying wire strand from a production facility, that is to say a shop in which the strand is stranded in any type of suitable production stranding equipment known to those skilled in the stranding art, in which only a limited number, i.e. two or three, wire sizes need be used in order to form an entire series of strands having uniform predetermined small intervals in size between the strands of the series. One convenient size interval to use is one-eighth of an inch. The adoption of one-eighth inch intervals between strand sizes will result in a series of readily producible strands which will fulfill the requirements of most strand users for different size strands.

In the production of wire strands in accordance with the present invention it is initially necessary to determine the smallest size strand which it will be desired to make in the series of predetermined strand sizes and also the size interval which it is desired to have between the uniformly increasing strand sizes in the series. The smallest strand size to be produced will be herein referred to as a strand having a diameter of "unity". Every strand in the series is then based upon the unity size strand.

In one method of carrying out the invention there are three stock wire sizes, and only three, used to produce all strand sizes in the strand production system. The first stock size of wire, which is the largest size, is used as the center wire of the strand and is only a little larger than the second stock size of wire. The third stock size of wire is smaller than the second stock size wire by about one half the predetermined interval which has been selected as the proper interval between the strand sizes to be produced. The third stock size of wire also has a diameter of 75% of the second stock size of wire.

In stranding a strand according to the first method of the invention, in order to fulfill an order for strand the largest stock wire is used as the center wire of the strand and a series of other wires selected from the other two stock wire sizes are used in the outer layers of the strand, which when a single wire size is used in each respective operation or layer of the strand, will build up a strand with the correct outer diameter within the predetermined series of sizes of strands. For example, if it is desired to make a strand of unity the largest stock wire is used as the center wire of the strand and two outer layers of the smallest, or third stock size wire, are stranded about the center wire. The stranding of two layers of these wires about the center wire will increase the effective size of the wire core to make a strand having a size equal to unity, the smallest strand of the series which can be made. The first layer of wires will contain seven of the outer third size wires and the outer layer of wires will contain 13 of the third size wires.

When a strand having a diameter of unity plus one interval is desired the strand will be made from one large center wire with six second diameter wires stranded about it and fifteen third diameter wire stranded about the first layer of wires. The change from a layer of third diameter or size stock wires to a layer of second diameter or size stock wires serves to increase the overall diameter of the strand by one predetermined interval since the second diameter stock wires are each one half of an interval larger than the third diameter stock wires. Since there are two wires in each layer of strand positioned on an axis or diameter through the strand, the strand diameter is rendered one interval larger by a change in wire size from the third stock wire to the second stock wire size.

When a strand having a diameter of unity plus two intervals is desired it may be made with one large central core wire, a first layer of six second diameter stock wires and a third layer of twelve outside second stock size wires. The additional change from a layer or operation of third diameter wires to a layer of second diameter wires again increases the diameter of the strand by one full interval.

When a strand having a diameter of unity plus three intervals is desired, one large central core or center wire will be used with seven third stock diameter wires stranded about the center wire, thirteen third stock diameter wires stranded about this inner layer and nineteen third stock diameter wires stranded about the center layer. When the two wire layers formed from second stock diameter wires are replaced with two layers of third stock diameter wires the diameter of the inner section of the strand is decreased by two intervals since each third diameter wire is one half an interval smaller than a second stock diameter wire. The addition of a third layer of third stock diameter wires to the outside of the strand will then increase the overall diameter of the strand by three intervals for a net increment of one additional interval. This increment arises because each third diameter stock wire is three quarters of the size of a second stock diameter wire or, in effect, one and one half intervals in diameter.

When a strand having a diameter of unity plus four is desired, one large center wire will be used with six second diameter stock wires stranded about the center wire, fifteen third diameter stock wires stranded about this first layer and twenty-one third diameter stock wires stranded about the second layer.

This same pattern is continued from one strand of the series to the next until a strand having a diameter of unity plus twenty-four or even more intervals is achieved. As will be seen from an analysis of the above described strand wire patterns, the sequence of addition is generally to start with a strand of unity, add a layer of third diameter wires to this basic strand to obtain a strand of unity plus 1 diameter and then to successively change each layer beginning on the inside to wires of the second diameter until all the layers are composed of wires of the second diameter, at which time, in order to obtain a strand of one additional incremental interval diameter, all of the layers are changed or switched back to third diameter wires again and an additional layer of third diameter wires is added to the outside of the strand. The third diameter wire layers are then gradually replaced by second stock diameter wires until a total of three second diameter wires is being used.

At this point the sequence again changes and a layer of third diameter wires is next added on to a base composed of a strand having a diameter of unity plus four intervals. This makes a unity plus 7 interval diameter strand. The next strand size (unity plus 8) is then made from a base strand having the same diameter of unity plus four with an additional layer of third stock diameter wires stranded about the base strand. The next strand size (unity plus 9) is made from a base strand having the next base diameter and construction (unity plus 5) with a layer of the second stock diameter wires laid about it. The next size strand (unity plus 10) will then be made from a base strand having a diameter and construction of unity plus 6 with an outer layer of second diameter stock wires laid about it. Each succeeding strand then for as far as one wishes to go, for example to unity plus 36 or more intervals in diameter will be constructed of an outer layer of second diameter wires laid over a base of unity plus four intervals less than the diameter of finished strand to be made. For example, a strand having a diameter of unity plus 14 will be constructed of a layer of second diameter wires over a unity plus 10 base, a unity plus 16 strand will be constructed of a layer of second diameter strands over a base of unity plus 12, a strand of unity plus 29 will be constructed of a layer of second stock diameter strands over a base strand diameter of unity plus 25 and so forth. The outer layer of second diameter wires of each successive strand after unity plus eight is either one or two more wires than the last successive strand. The following is a listing of the various strand sizes and constructions according to this first principal method of carrying out the invention.

| Diameter of Strand to be made (Unity plus 1 interval, 2 intervals, etc. | Construction |
|---|---|
| unity | 13-3rd wire size/7-3rd wire size/1-1st wire size |
| unity + 1 | 15-3rd w.s./6-2nd w.s./1-1st w.s. |
| unity + 2 | 12-2nd w.s./6-2nd w.s./1-1st w.s. |
| unity + 3 | 19-3rd w.s./13-3rd w.s./7-3rd w.s./1-1st w.s. |
| unity + 4 | 21-3rd w.s./15-3rd w.s./6-2nd w.s./1-1st w.s. |
| unity + 5 | 23-3rd w.s./12-2nd w.s./6-2nd w.s./1-1st w.s. |
| unity + 6 | 18-2nd w.s./12-2nd w.s./6-2nd w.s./1-1st w.s. |
| unity + 7 | 27-3rd w.s. + unity plus 4 base |
| unity + 8 | 21-2nd w.s. + unity plus 4 base |
| unity + 9 | 22-2nd w.s. + unity plus 5 base |
| unity + 10 | 24-2nd w.s. + unity plus 6 base |
| unity + 11 | 25-2nd w.s. + unity plus 7 base |
| unity + 12 | 27-2nd w.s. + unity plus 8 base |
| unity + 13 | 28-2nd w.s. + unity plus 9 base |
| unity + 14 | 30-2nd w.s. + unity plus 10 base |
| unity + 15 | 31-2nd w.s. + unity plus 11 base |
| unity + 16 | 33-2nd w.s. + unity plus 12 base |
| unity + 17 | 34-2nd w.s. + unity plus 13 base |
| unity + 18 | 36-2nd w.s. + unity plus 14 base |
| unity + 19 | 37-2nd w.s. + unity plus 15 base |
| unity + 20 | 38-2nd w.s. + unity plus 16 base |
| unity + 21 | 40-2nd w.s. + unity plus 17 base |
| unity + 22 | 42-2nd w.s. + unity plus 18 base |
| unity + 23 | 43-2nd w.s. + unity plus 19 base |
| unity + 24 | 44-2nd w.s. + unity plus 20 base |
| unity + 25 | 46-2nd w.s. + unity plus 21 base |
| unity + 26 | 48-2nd w.s. + unity plus 22 base |
| unity + 27 | 49-2nd w.s. + unity plus 23 base |
| unity + 28 | 50-2nd w.s. + unity plus 24 base |
| unity + 29 | 52-2nd w.s. + unity plus 25 base |
| unity + 30 | 54-2nd w.s. + unity plus 26 base |
| unity + 31 | 55-2nd w.s. + unity plus 27 base |
| unity + 32 | 56-2nd w.s. + unity plus 28 base |
| unity + 33 | 58-2nd w.s. + unity plus 29 base |
| unity + 34 | 60-2nd w.s. + unity plus 30 base |
| unity + 35 | 61-2nd w.s. + unity plus 31 base |
| unity + 36 | 62-2nd w.s. + unity plus 32 base |

A particularly convenient interval to adopt between strand sizes is one-eighth of an inch in the English system of measurement. The requirements of many, if not most, customers for strand can be supplied from a system which adopts an interval of one-eighth of an inch between strand sizes. With a one-eighth inch interval the proper wires to use in the strand are a nominal 0.261 inch wire as the initial stock wire size, a 0.250 inch wire as the second stock wire size and a 0.188 inch wire as the third stock wire size. A wire of 0.188 inch diameter is just three-quarters of the diameter of a wire 0.250 inches in diameter. Using wires of these diameters and a one-eighth inch interval between the strand sizes the strands made in conformance with the present invention can be illustrated by the following table.

TABLE I

SEQUENTIAL SIZE WIRE STRAND

| INTERVAL | DIAMETER (IN.) | CONSTRUCTION | DESIGNATION | MACHINE OPERATIONS | DIAMETERS |
|---|---|---|---|---|---|
| 0 | 1 | 13/.188" 7/.188" 1/.261" | b2 | 2 | 1.013/637 |
| 1 | 1⅛ | 15/.188" 6/.250" 1/.261" | b1 | 2 | 1.137/.761 |

TABLE I-continued

SEQUENTIAL SIZE WIRE STRAND

| INTERVAL | DIAMETER (IN.) | CONSTRUCTION | DESIGNATION | MACHINE OPERATIONS | DIAMETERS |
|---|---|---|---|---|---|
| 2 | 1¼ | 12/.250" 6/.250" 1/.261" | b0 | 2 | 1.261/.761 |
| 3 | 1⅜ | 19/.188" 13/.188" 7/.188" 1/.261" | b3 | 3 | 1.389/1.013/.637 |
| 4 | 1½ | 21/.188" 15/.188" 6/.250" 1/.261" | b2 | 3 | 1.513/1.137/.761 |
| 5 | 1⅝ | 23/.188" 12/.250" 6/.250" 1/.261" | b1 | 3 | 1.637/1.261/.761 |
| 6 | 1¾ | 18/.250" 12/.250" 6/.250" 1/.261" | b0 | 3 | 1.761/1.261/.761 |
| 7 | 1⅞ | 27/.188" 1½" Base | b3 | 4 | 1.889 |
| 8 | 2 | 21/.250" 1½" Base | b2 | 4 | 2.013 |
| 9 | 2⅛ | 22/.250" 1⅝" Base | b1 | 4 | 2.137 |
| 10 | 2¼ | 24/.250" 1¾" Base | b0 | 4 | 2.261 |
| 11 | 2⅜ | 25/.250" 1⅞" Base | b3 | 5 | 2.389 |
| 12 | 2½ | 27/.250" 2" Base | b2 | 5 | 2.513 |
| 13 | 2⅝ | 28/.250" 2⅛" Base | b1 | 5 | 2.637 |
| 14 | 2¾ | 30/.250" 2¼" Base | b0 | 5 | 2.761 |
| 15 | 2⅞ | 31/.250" 2⅜" Base | b3 | 6 | 2.889 |
| 16 | 3 | 33/.250" 2½" Base | b2 | 6 | 3.013 |
| 17 | 3⅛ | 34/.250" 2⅝" Base | b1 | 6 | 3.137 |
| 18 | 3¼ | 36/.250" 2¾" Base | b0 | 6 | 3.261 |
| 19 | 3⅜" | 37/.250" 2⅞" Base | b3 | 7 | 3.389 |
| 20 | 3½ | 38/.250" 3" Base | b2 | 7 | 3.573 |
| 21 | 3⅝ | 40/.250" 3⅛" Base | b1 | 7 | 3.637 |
| 22 | 3¾ | 42/.250" 3¼" Base | b0 | 7 | 3.761 |
| 23 | 3⅞ | 43/.250" 3⅜" Base | b3 | 8 | 3.889 |
| 24 | 4 | 44/.250" 3½" Base | b2 | 8 | 4.013 |
| 25 | 4⅛ | 46/.250" 3⅝" Base | b1 | 8 | 4.137 |
| 26 | 4¼ | 48/.250" 3¾" Base | b0 | 8 | 4.261 |
| 27 | 4⅜ | 49/.250" 3⅞" Base | b3 | 9 | 4.389 |
| 28 | 4½ | 50/.250" 4" Base | b2 | 9 | 4.513 |
| 29 | 4⅝ | 52/.250" 4⅛" Base | b1 | 9 | 4.637 |
| 30 | 4¾ | 54/.250" 4¼" Base | b0 | 9 | 4.761 |
| 31 | 4⅞ | 55/.250" 4⅜" Base | b3 | 10 | 4.889 |
| 32 | 5 | 56/.250" 4½" Base | b2 | 10 | 5.013 |
| 33 | 5⅛ | 58/.250" 4⅝" Base | b1 | 10 | 5.137 |
| 34 | 5¼ | 60/.250" 4¾" Base | b0 | 10 | 5.261 |
| 35 | 5⅜ | 61/.250" 4⅞" Base | b3 | 11 | 5.389 |
| 36 | 5½ | 62/.250" 5" Base | b2 | 11 | 5.513 |

The above table indicates in the column at the left the number of intervals from unity, in the second column from the left the nominal or ordering size of the strand, and in the third column the construction of the strand. The fourth column is a convenience designation indicating the number of layers of 0.188 inch or third size wire which will occur in the final strand. In this column b1 stands for one layer of 0.188 inch wire, b2 for two layers of 0.188 inch wire and so forth. This information is a convenience in ordering sufficient wire to make any given order of strand or in keeping track of the amount of wire drawn from inventory. The fifth column of the table shows the number of stranding machine operations, or layers, through a stranding machine necessary to make the particular strand in a case where the stranding machine available is equipped with a maximum of 36 bobbins of wire for one normal operation and a maximum of 72 available bobbins on a single pass through the stranding machine. Naturally if the particular stranding machine or machines which are available in any given shop or upon which the strand is to be made are larger or smaller with respect to the number of bobbins and the like, the number of operations or passes through the stranding apparatus will vary from the particular designation of layers indicated in the table. The last column of the table shows in inches to the third decimal place the actual or theoretical diameter of each strand made according to the invention plus in the case of the first few strands the theoretical diameter of the intervening strands made in each of the operations.

While it is much preferable for the central wires of the initial strand to have a diameter slightly greater than the second diameter wire, for instance, as shown on the table, having a nominal diameter of 0.261 inches rather than 0.250 inches, it is also possible for the two wire sizes, or, in other words for the first and second stock wire sizes to be the same. In this case a 0.250 inch wire will be substituted for the 0.261 inch center wire. The 0.261 inch wire is actually considered to be a nominal 0.250 inch wire, but is preferable as a center wire of a strand in order to prevent too close a clearance between the wires stranded about the center wire. It is advantageous to have at least a slight clearance between the outer wires to avoid "popping" of the wires out of position. Adjustments of the length of lay of the wires about the center wire may also serve to make some adjustments as to packing of the wires.

A second principal method of making a predetermined strand series according to the present invention may be used to produce strand made with a smaller interval between stock strand sizes of the predetermined series of strands. The second principal method is accomplished by stocking just two stock wire sizes, the first wire size being a predetermined size smaller than the second wire size. The predetermined size by which the wires differ in diameter is equal to the interval which it is desired to have between the strand sizes in the system of strands. As in the first principal method of the invention, the smaller of the two wires is three-quarter of the diameter of the larger of the two stock wires used in the series.

In the second principal method of producing the wire strand system of the invention an initial wire core having a diameter of unity will be constructed by stranding a first strand composed of a center wire of the first diameter having an operation of first diameter wires stranded about it. In this second method according to the invention a strand having a diameter of unity plus one interval will then be composed of a center wire of the second or larger stock wire size (which is one interval larger than the first wire size) with an outer operation or layer of the first (or smaller) wire size. A strand having a diameter of unity plus two intervals will then be constructed from a center wire of the first or smaller wire size plus one operation or layer of the second or larger wire size. By decreasing the single center wire size one interval and increasing the outer wire size one interval, the effective diameter of the strand is increased one full interval since there are two outer wires across the diameter of the strand but only one center wire across the diameter of the strand. Thus one interval is subtracted as two intervals are added to the diameter resulting in a net increment in diameter of one interval. The next strand diameter of unity plus three intervals is constructed of a center wire of the second or larger size plus an outer operation or layer of second diameter wires. It will be recognized that by increasing the size of the center wire one interval the overall diameter of the strand is increased by one interval.

The next two intervals of strand diameter, i.e. unity plus four and unity plus five, are, because of the peculiarities of wire sizes and packing arrangements, not manufacturable by the use of the two primary stock wire sizes and thus do not exist in the predetermined system of strands according to the invention. A strand having a diameter of unity plus six intervals, however, would be composed of a center comprised of a first or smaller center wire plus two operations or layers of first wire size stranded consecutively about the center wire. A strand of unity plus seven would then be constructed by using a center wire composed of second stock size wire, or the larger wire size, plus the same two operations or layers of first, or smaller, wire size stranded about the center wire thus effectively increasing the diameter of the strand by one interval of diameter. A strand of unity plus eight diameters would be constructed by using a first or smaller center wire plus one operation or layer of first or smaller wire size and one operation of second or larger wire size effecting a net increment of diameter of the strand of one interval. A strand of unity plus nine intervals would be comprised of a center wire of the second or larger stock wire size plus one second wire size and one first wire size operation or layer about the center of the strand. A strand of unity plus ten intervals would be composed of a first wire center and two outer operations of second, or larger, stock wire giving a net increment again of one interval in diameter for the overall strand. A strand of unity plus eleven would be composed of a second or larger wire center plus two operations of second wire size. A strand having a diameter, on the other hand, of unity plus twelve intervals would have a center wire of the first wire size plus three outer operations of first wire size. Thus by subtracting one interval from the size of the center wire and two intervals each from the size of the two outer layers of the strand, or a total decrease of five intervals, and at the same time adding one extra layer of first diameter wires, there is a net increase of one interval to the outside diameter of the strand.

The next strand size, namely unity plus thirteen intervals, is composed of a center wire composed of a second or larger size wire plus three operations or layers of first size wire. A strand having a diameter of unity plus fourteen intervals on the other hand is composed of a first wire size center wire plus two operations of first wire size and one operation or layer of second wire size. The strand series can be almost indefinitely extended beyond this point by alternating the size of the center wire between the first wire size and the second wire size while simultaneously, each time the center wire returns to the smaller first wire size, increasing the size of the wires in one of the outer layers of the strand. When all of the layers plus the center wire are composed of second wire sizes then the size of all the wires in the first two layers and the center wire of the strand are returned to the first or smaller wire size and an additional layer of outer first or smaller wires is added to the outside of the strand.

One very satisfactory embodiment of the invention using two sizes of stock wires in accordance with the above is one in which the first smaller size wire is 0.188 inches in diameter and the second larger size wire is 0.250 inches in diameter.

It will be noted that these are the same two principal wires as are so effectively used in the first principal method of the invention as a preferred embodiment except that in the first principal method the smallest or 0.188 inch wire is referred to as the third wire of the series, while in the second principal method the 0.188 inch wire is referred to as the first wire of the two wires in this series. This is because it is convenient to designate the center wire of a strand of unity as the first wire of the particular series and the center wire in the first series is always a larger wire, while in the second series the initial center wire in a strand of unity is the smaller of the two wires. It is usually advantageous in production time to use the largest sizes of wire possible or permissible while still maintaining the necessary properties of the wire. A 0.188 inch wire, is, furthermore, just seventy-five percent of the diameter of the 0.250 inch wire making the wire geometry proper for the fabrication of both series of the strands of the invention. The use of larger rather than smaller wires in a strand is, other things being equal, deisrable in order to have as few wires as possible in the strand in order to cut down on the operations necessary to both make the wire and to strand or lay the wire into a wire strand. The addition of a few extra wires in the strand may often be enough to require passage of the strand through another operation or pass in the stranding apparatus if the capacity of the strander is exceeded by the number of wires in the strand. Each extra operation means additional handling and time for production with resultant increase in manufacturing expense.

It will be evident from the foregoing that the two principal embodiments of the present invention are closely related in that when a 0.250 inch wire is used in the first described embodiment, which normally uses three wire sizes, some of the strands made by both systems correspond. For example the strand conforming to unity plus nine intervals in the second embodiment would then be substantialy identical to a strand of unity plus two intervals in the first principal embodiment and a strand of unity plus thirteen in the second principal embodiment would be the same as unity plus three in the first principal embodiment. It will be recognized that there are also other structures of strands made in the two principal embodiments which are substantially identical.

A chart may be constructed to illustrate the use of a first wire size of 0.188 inches and a second wire size of 0.250 inches in the present invention as described above with respect to the second principal method of the invention. Such a chart or table is shown in the FIG. 1 attached hereto. The table shown in FIG. 1 is designed to quickly indicate the general construction of wire strands using the 0.188 inch and 0.250 inch wires in accordance with the invention.

This chart or table is read down along the left edge to find the size of strand which will be made by various numbers of 0.250 inch wires across the diameter of the strand and along the top edge to find the size or diameter of strand which will be made by various numbers of 0.188 inch wires across the diameter of the strand. Strands composed of mixtures of the two wire sizes can be found in the body of the chart. The nominal sizes in inches and fractions of an inch ae shown in the body of the chart the actual theoretical size in whole and decimal parts of an inch are shown in the body of the chart. When ordering a strand the size of the strand is found in the body of the chart and the number of layers of both 0.188 inch and 0.250 inch wires are read off from the top and side of the chart respectively. Lines pass through non-existent strand constructions. The diagonal lines also enclose within their boundaries all of the strands of the series constructed of the same number of wires. The total number of wires in each respective strand can be read off the top and the side of the table respectively. The center wire diameter is always the odd number at the edge of the chart corresponding to the coordinates of the strand diameter and the number at the other side of the chart is always an even number indicating full outer layers of wires about the strand each of which layers contributes two wires to the strand diameter. The sequence of progressively larger numbers of wires can be read off the chart from the top and the left. The sequence of strand sizes progressing from the largest to the smallest size can be read consecutively along the diagonals progressing from the top down across the page to the left and then beginning again at the top of the chart or to the left of the line designated as the "repetition line" or limit.

The vertical line designated repetition line down the center of the table or chart indicates the limit of repetition of the predetermined system of wire strands. It will be noted that the first strand size to the left of the line is in each case the next continuing size strand in the series continued from the diagonal series directly above. The strand size immediately to the right of the line is, however, a repetition of the last strand size in the immediately preceding diagonal column, constructed, however, of more 0.188 inch wires and less 0.250 inch wires. In each case the actual size of the strands as compared with the nominal size is slightly greater in the strands to the right of the repetition line than to the left of the line.

Since the use of increasing numbers of smaller wires in place of larger wires requires the use of more total wires to attain the same diameter strand, it is advantageous to use more of the larger size wires since the wire is then not only subjected to fewer drawing operations, but the number of wires to be handled is also less. It will be recognized furthermore, that it is often a serious disadvantage to use more wires than necessary in a construction since a few more wires in a construction may result in having to pass the strand through the stranding apparatus additional times. Therefore, the preferred strand constructions to the left of the repetition line will normally be used in the series. If, however, alternate constructions using proportionately more of the smaller wires are designed for one application or another the alternative constructions to the right of the line may also be used and are encompassed in the present invention.

This invention is useful for the production of wire strand such as bridge strand, strand for use for boom pendants and other types of structural and semi-structural strands such as the strand used for roof supports and guy lines and the like, and also working strands such as used for drag lines and the like, and even strand used in making wire rope and the like.

SPECIFIC EXAMPLE

Referring to FIG. 1, it is desired to determine the construction of a 2⅞ inch nominal diameter strand. Entering the table from the left hand side the channel containing the 2⅞ inch diameter strand is located. The number of 0.188 diameter wires across the strand center line is noted as 6 at the top of the column directly above the 2⅞ inch diameter designation. Going horizontally to the left edge of the table the number 7 is noted for the number of 0.250 diameter wires across the strand center line. Following up the channel to the upper end thereof the strand construction is noted as being 1X127. Since there are an odd number of 0.250 diameter wires across the centerline, the core wire diameter will be 0.250 inch.

As mentioned above, the two principal embodiments of the invention when using 0.250 inch wires in place of the preferred 0.261 inch wires for the center wire of the strand are closely related in that in this instance many of the constructions of strands in the two embodiments are in fact identical. Close inspection of the two principal methods of the invention will show that the two principal methods are in fact variations of a single broad method in that the first method is actually a simplification or abbreviation of the second method using a preferred wire size for the center wire of the strand. Thus it will be noted that when only the strand constructions occuring at one-eighth intervals and beginning at one inch strand are considered in the chart shown in the FIG. 1, the constructions are similar to the constructions in Table I. That is to say that, if one inch cable in the chart in the FIG. 1 is taken as unity and one eighth inch intervals of strand only are read from the chart, then the constructions of strand would be substantially the same as in Table I if a 0.250 inch wire is substituted for the preferred 0.261 inch center wire in Table I. It will be clear from this that the strand constructions of the first principal method of the invention are actually selected intervals or constructions of the second principal method of the invention using as unity a strand size which occurs beyond the missing or non-existent strand sizes in the second series of strands. It will additionally be clear from this that it would also be advantageous to use 0.261 inch in place of the 0.250 inch wire size for the center wires of the strands in the second embodiment and that it would also be advantageous to use a somewhat larger size wire in place of the 0.188 inch wire in the second embodiment when this wire is to be used as the center wire of the strand. Such a wire size might be a 0.195 inch or more diameter wire. It will be clear also that in both instances the amount by which the actual size of the center wire of the strand exceeds its nominal size is not critical and a large number of sizes of slightly enlarged wires with respect to nominal size may be used so long as the wire is sufficiently enlarged to provide some clearance between the wires stranded about the enlarged wire, but not so large as to provide excessive clearance between the outer wires. A range of ten to fifteen thousandths of an inch increase in the center wire size is very satisfactory in most instances. Thus an oversize 0.250 inch wire would desirably be from 0.261 to 0.266 inches in diameter and an oversize 0.188 inch wire would desirably be from 0.198 to 0.203 inches in diameter. Because of wire geometry it is more desirable that 0.250 inch wire be overize when used as the center wire than that 0.188 inch wire be oversize. It will be evident also that when other actual wire sizes are used in place of the 0.188 inch and 0.250 inch wire for the outer wire layers of the strand the same general additional size increment for the center wire is also desirable, but, in the same manner, not critical. The use of an oversize wire for the 0.188 inch center wire does, of course, involve the stocking of an extra wire size so that the second principal method of the invention would require in actuality, if practiced with desirably oversized center wires, four stock wire sizes rather than two. However, since there is only a single relatively short length of center wire in each strand, the inventory involved is not great.

The invention is not restricted, of course, to the use of 0.188 inch and 0.250 inch wires in either the outer or inner layers of the strands, but only to the stocking, basically, of two wire sizes which differ from each other in diameter by a predetermined even fraction, including one, of the predetermined desired interval between strands in the series of strands to be made and in which the smaller of the two wires is three-quarters of the size of the larger of the two wires. Any strand diameter conforming to the predetermined interval between strands, or multiples of this interval, can then be built up using the two wire sizes. The measurement of the wires and strands may be in either the English system as illustrated or the metric system, so long as the basic size relatonships and constructions remain the same.

I claim:

1. A wire strand having a diameter range from 1 inch to 5½ inches in which range the difference in diameters between any two successive strands is a constant and said wire strand is formed from no more than three wire sizes which include:

a. a first wire;

b. a second wire with a size smaller than said first wire;

c. a third wire with a size which is:

i. smaller than said second wire by one-half the constant difference in diameters between successive strands, and ii. equal to 75% of the size of said second wire, and d. said wires are arranged according to the construction set forth in Table I of the specification, whereby said three wire sizes allow all sizes of strand within said diameter range to be manufactured.

2. A wire strand according to claim 1 wherein a. said first wire has a diameter of 0.261 inch, b. said second wire has a diameter of 0.250 inch, c. said third wire has a diameter of 0.188 inch, and d. said difference in diameters between any two successive strands is ⅛ inch.

3. A wire strand having a diameter range from 9/16 inch to ¼ inch and from 15/16 inch to 6¼ inches in which range the difference in diameters between any two sucessive strands is a constant and said wire strand is formed from no more than two wire sizes which include:

a. a first wire, b. a second wire, c. said first wire is i. smaller than said second wire by the difference in diameters between any two successive strands, and ii. equal to 75% of the diameter of said second wire, and d. said wires are arranged according to the construction set forth in FIG. 1 of the specification, whereby said two wire sizes allow all sizes of strand within said diameter range to be manufactured.

4. A wire strand according to claim 3 wherein a. said first wire has a diameter of 0.188 inch, b. said second wire has a diameter of 0.250 inch, and c. said difference in diameter between any two successive strands is 1/16 inch.

* * * * *

UNITED STATES PATENT OFFICE

CERTIFICATE OF CORRECTION

Patent No. 3,972,175 Dated August 3, 1976

Inventor(s) Carl D. Hiller

It is certified that error appears in the above-identified patent and that said Letters Patent are hereby corrected as shown below:

Column 1, under the "Background of the Invention", line 29, the word "strands" to read -- strand --.

Column 1, line 64, the word "now" should read --not--.

Column 2, line 13, under the "Summary of the Invention" the word "a" should read --an--.

Column 2, under the "Summary of the Invention", line 54, after "the second wire" the word "size" should be inserted.

Column 11, line 11, the word "ae" should read --are--.

Column 11, lines 12 and 13, the words "the actual theoretical size in whole and decimal parts of an inch are shown in the body of the chart" should be deleted.

Column 11, line 65, "designed" should be --desired--.

Column 12, line 52, after the word "use" insert --a--.

Column 14, line 20, "1/4" should read --3/4--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*